US006308834B1

(12) United States Patent
Peaker et al.

(10) Patent No.: US 6,308,834 B1
(45) Date of Patent: Oct. 30, 2001

(54) FLOTATION TANK IMPELLER

(75) Inventors: Richard Asheton Peaker, London (GB); William John Schlittler, Colorado Springs; Joseph Rene Trudel, Monument, both of CO (US); Ulf Krister Svensson, Sala (SE)

(73) Assignee: Svedala Limited, Leatherhead (GB)

( * ) Notice: Subject to any disclaimer, the term of this patent is extended or adjusted under 35 U.S.C. 154(b) by 0 days.

(21) Appl. No.: 09/011,801

(22) PCT Filed: Aug. 14, 1996

(86) PCT No.: PCT/GB96/01984

§ 371 Date: Apr. 9, 1998

§ 102(e) Date: Apr. 9, 1998

(87) PCT Pub. No.: WO97/06892

PCT Pub. Date: Feb. 27, 1997

(30) Foreign Application Priority Data

Aug. 17, 1995 (GB) ..... 9516873

(51) Int. Cl.[7] ..... B03D 1/16; B01F 3/04

(52) U.S. Cl. ..... 209/169; 261/87; 261/93; 366/102; 366/317

(58) Field of Search ..... 209/169; 261/87, 261/93; 366/317, 102

(56) References Cited

U.S. PATENT DOCUMENTS 2,393,976 * 2/1946 Daman .
3,882,016 * 5/1975 Green .
3,953,151 4/1976 Aryus et al. .
4,444,510 4/1984 Janssen .
4,692,244 9/1987 Supp et al. .

FOREIGN PATENT DOCUMENTS

2137332 * 6/1995 (CA) .
0092769 A3 11/1983 (EP) .
0287251 A3 10/1988 (EP) .

* cited by examiner

*Primary Examiner*—Thomas M. Lithgow
(74) *Attorney, Agent, or Firm*—Kinney & Lange P.A.

(57) ABSTRACT

An impeller for use with apparatus to enhance mixing of a gas and a liquid, as used for example in froth flotation apparatus, having a substantially upright portion (11) substantially parallel to the axis of rotation (17), and a plurality of vanes (12) extending outwardly therefrom, at least some of the vanes (12) having an upper part (19) adapted to induce liquid flow generally downwardly towards the impeller and a lower part (20) adapted to induce liquid flow generally upwardly towards the impeller, wherein the impeller further comprises barrier means (14) at least partially dividing the upper and lower parts, and a gas input situated on the same side of the barrier means (14) as the lower part (20). The barrier means (14) may comprise a flange like member in a plane generally perpendicular to the axis of rotation (17) and may intersect, or be integral with at least part of the vanes.

22 Claims, 4 Drawing Sheets

FLOTATION TANK IMPELLER

FIELD OF THE INVENTION

This invention relates to an impeller primarily but not exclusively for use with apparatus adapted to enhance mixing of a gas and a liquid, as used for example in froth flotation apparatus for separation of substances.

DESCRIPTION OF THE PRIOR ART

Froth flotation is a process currently used in both mineral processing to separate required mineral particles from gangue in a mineral ore slurry and in other processing systems when a separation of one liquid type or types can be made from another liquid or liquids. The apparatus utilised comprises a tank for holding the slurry, an impeller for inducing flow of the slurry and dispersing a gas therein, a static diffuser arrangement located outwardly of the impeller and a means to introduce the gas, commonly compressed air, into the slurry.

It will be appreciated that the term "mixing" used herein should be read as relating to dispersion of a gas in a liquid, true homogeneity not necessarily being achieved by introduction of the gas into the liquid. Furthermore, the term liquid will hereinafter he used although it will be appreciated that during use of the apparatus the liquid may contain solid matter and thus constitute a slurry, and the term slurry should be understood to comprise a suspension of solid particles in a liquid in general, and not be limited to any particular mineral suspension.

The mechanism of the extraction process is known in the art, and will therefore not be described here in any great detail, although an outline of the principal when used in mineral processing is to cause the required mineral particles to adhere to bubbles of the gas, which then rise to the surface of the liquid to form a froth which is removed. A plurality of such tanks may be provided in series with the liquid passing through each in turn, such that any required minerals not extracted in a given tank may be subjected to a further extraction process in the next tank in the series, or a single tank housing a plurality of gas/liquid mixing apparatus may he provided.

SUMMARY OF THE INVENTION

It is an object of the present invention to provide an improved impeller which enhances the above mixing process and improves the efficiency of the extraction process.

According to a first aspect of the invention there is provided an impeller for rotation about a substantially upright axis for use with apparatus adapted to enhance mixing of a gas and a liquid, the impeller having a substantially upright portion substantially parallel to the axis, and a plurality of vanes extending outwardly therefrom, at least some of the vanes having an upper part adapted to induce liquid flow generally downwardly towards the impeller and a lower part adapted to induce liquid flow generally upwardly towards the impeller, wherein the impeller further comprises barrier means at least partially dividing said upper and lower parts, and a gas input situated on the same side of the barrier means as the lower part.

Preferably, the barrier means extends outwardly from the substantially upright portion.

The barrier means preferably comprises a flange-like member having upper and lower faces, at least one face of which is flat or substantially flat. Preferably the lower face is the flat or substantially flat face.

Preferably the flange-like member is substantially planar. Conveniently the flange-like member lies in a plane substantially perpendicular to the axis of rotation. The flange-like member may conveniently be disc shaped.

The substantially upright portion may comprise a cylinder-like portion wherein the vanes extend outwardly from the outer surface of the cylinder-like portion. Conveniently, the vanes extend radially outwardly from the cylinder-like portion. The vanes may be secured to the outer surface of the cylinder-like portion, or may pass partly therethrough.

The substantially upright portion preferably has at least one passage therein. Conveniently, the or each passage lies substantially parallel to the axis of rotation of the impeller.

A lower end of the substantially upright portion is preferably located below the plane of the barrier means.

Conveniently, the or each passage has an input end adapted to receive at least one gas and an output end adapted to emit the or each gas to the tank. Preferably the input end is adapted to be connected, in use, to a gas source which is at greater than atmospheric pressure.

Conveniently, the output end is situated at or near the lower end of the substantially upright portion.

As an alternative, the substantially upright portion may be substantially hollow. Preferably the substantially upright portion comprises a tube. The tube may also have an input end and an output end analogous to those described above.

Conveniently, only a part of the vanes engage the substantially upright portion.

The barrier means preferably comprises an annulus, the inner rim of which is located substantially adjacent the outer surface of the tube. Conveniently, the radius of the annulus is less than the dimension of the vanes in a radial direction. Such a direction will henceforth be referred to as the width of the vanes, and, correspondingly, the dimension perpendicular to the width, and thus parallel with the axis of rotation of the impeller, will be referred to as the height.

The upper part of the vanes preferably has a top edge and inner and outer side edges, wherein the inner side edge abuts or passes into the substantially upright portion, and wherein the outer side edge is remote from the substantially upright portion. The outer side edge of the upper part sweeps through the liquid in the tank in a rotational manner in order to induce flow of the liquid. The top edge of the vane and the outer side edge of the upper part of the vane may meet substantially at right angles to each other to define a corner of the vane.

Alternatively however, the top edge of the vane and the outer side edge of the upper part of the vane may be joined by an intermediate edge.

The intermediate edge may be generally linear, or may be of curved configuration. Preferably, the curved configuration is concave.

The lower part of the vane has a bottom edge, and inner and outer side edges. Preferably, the inner side edge is located at or near the axis of rotation. Accordingly, where there are a plurality of such vanes, the inner side edges of each preferably meet at or near the axis of rotation.

There is preferably an intermediate edge between the bottom edge and outer side edge of the lower part of the vane. Conveniently, the intermediate edge is of curved configuration suitable to induce flow of the liquid generally upwardly towards the impeller. Preferably, the curved configuration is concave.

Alternatively, the substantially upright portion may comprise a cylinder-like portion wherein the vanes extend outwardly therefrom but do not engage the outer surface of the cylinder-like portion. In such a case, the cylinder-like portion may have associated therewith a flange, henceforth referred to as a drive flange for the sake of clarity. The drive flange is preferably of annular configuration. Preferably, the barrier means is attached to or integral with the drive flange. In this alternative, the barrier means comprises a first part attached to or integral with the drive flange, and a second part extending radially outwardly from the first part.

Preferably, the second part engages at least some of the vanes. Preferably, both the first and second parts are substantially annular, having substantially flat lower faces. In this alternative, the distance between opposite inner side edges of the upper parts of the vanes is preferably greater than the diameter of the cylinder-like portion. Conveniently, said distance is greater than the diameters of both the drive flange and the first part of the barrier means. The inner side edges of the lower parts of the vanes, in this alternative, do not meet at or near the axis of rotation. There is preferably provided a central portion which engages said inner side edges.

Conveniently, the central portion comprises a cylinder, the outer surface of which engages said inner side edges. The diameter of said central portion is preferably greater than the diameter of the substantially upright portion.

It is further envisaged that there may be provided baffle means between adjacent vanes of the impeller. The baffle means may have a concave outer surface.

In an alternative arrangement, the substantially upright portion may comprise a cylinder like portion the ends of which are sealed or substantially sealed. Such a cylinder like portion may be solid. In such an arrangement, a lower end of the cylinder like portion may be attached to, or integral with, the vanes at a position below the plane of the barrier means. In this arrangement, there may be further provided an outer pipe, preferably concentric with the cylinder like portion, which does not rotate with the vanes. Preferably, gas is emitted to the impeller through the outer pipe, which has an open lower end. The lower end of the outer pipe is also preferably located below the plane of the barrier means.

According to a second aspect of the invention, there is provided a method of mixing a gas and a liquid, comprising the steps of introducing the gas to the liquid, and inducing flow of the gas and liquid to enhance mixing thereof by use of an impeller in accordance with the first aspect of the invention.

BRIEF DESCRIPTION OF THE DRAWINGS

The invention will now be described in greater detail by way of example only with reference to the accompanying drawings wherein.

DETAILED DESCRIPTION

Figure 2:
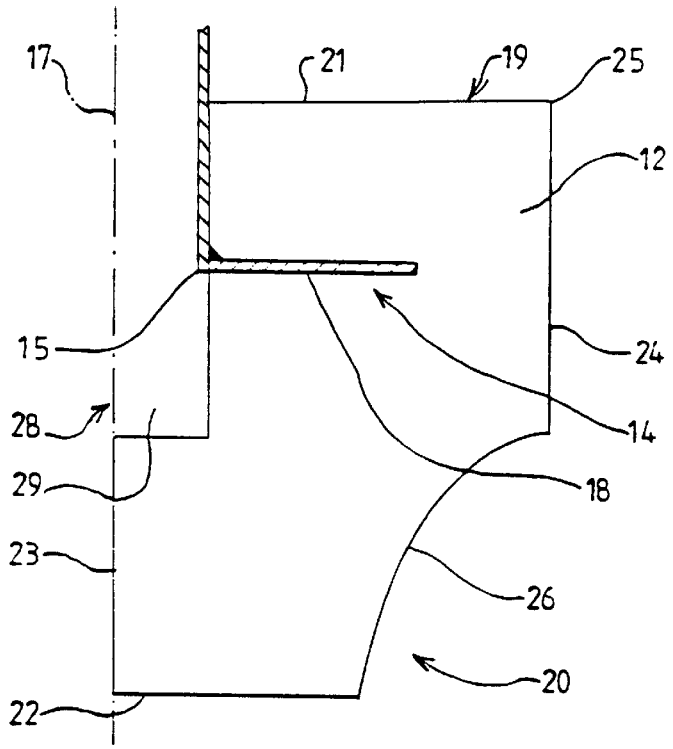
FIG. 2 is a side view of one of the vanes of the impeller and part of the barrier means.
Figure 1:
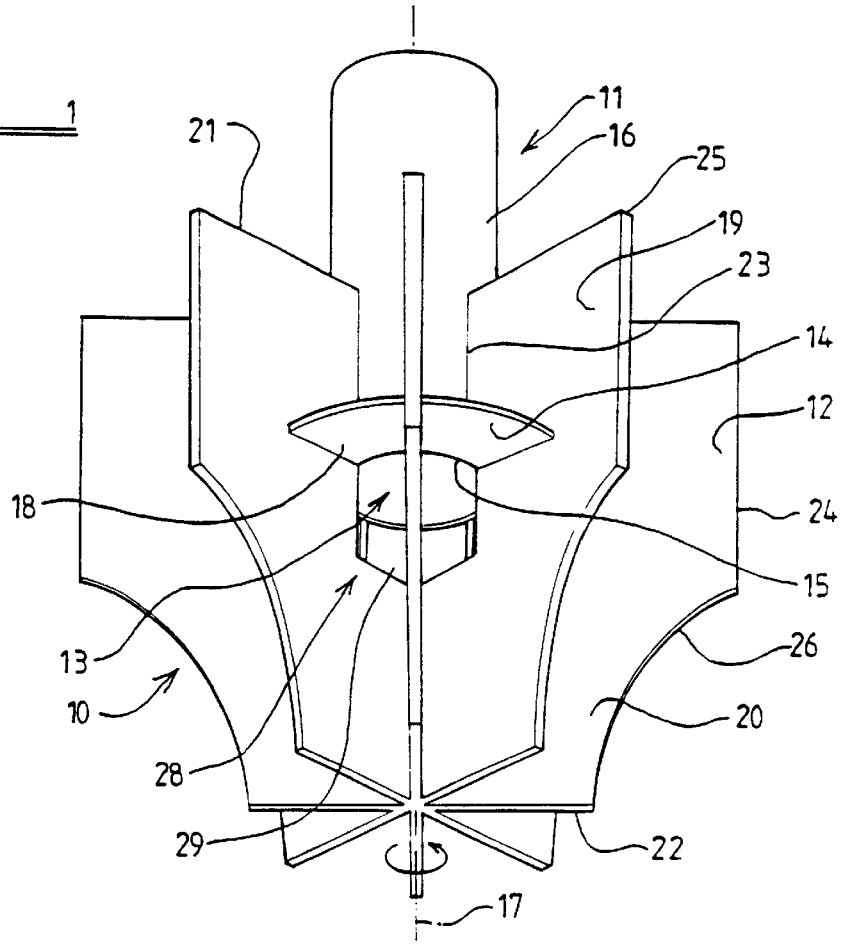
FIG. 1 is a perspective view of an impeller according to the invention.
Figure 3:
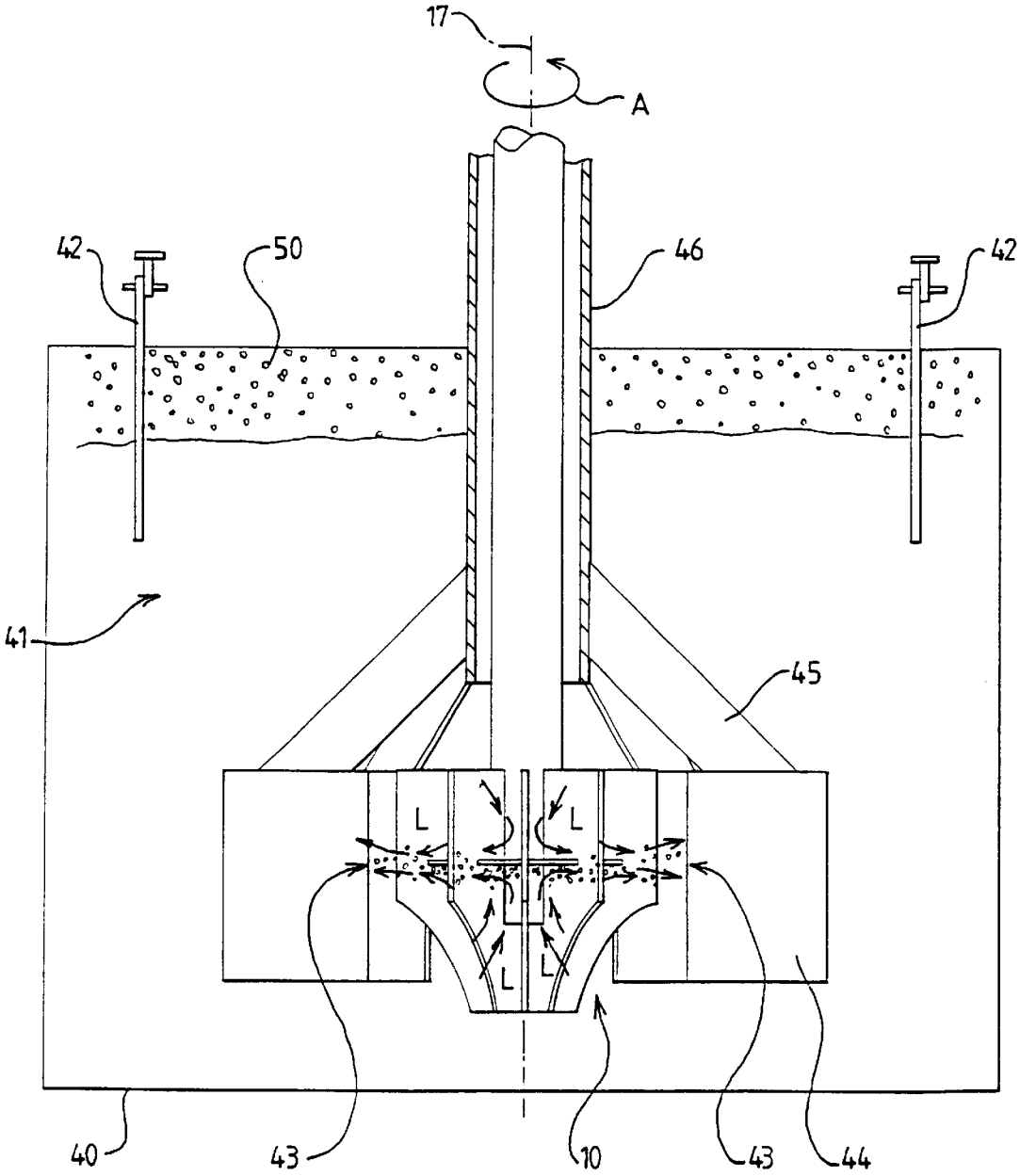
FIG. 3 is a schematic diagram of froth flotation apparatus incorporating the impeller.

Referring to FIGS. 1 to 3, an impeller 10 is shown comprising a substantially upright portion which in this example is a hollow tube 11. There are provided eight outwardly extending vanes 12 which are attached to the outer surface 16 of the hollow tube by any suitable means, for example welding. The hollow tube extends approximately mid-way along the vanes in a vertical direction. There is provided near the lower end 13 of the tube 11 a flange 14 which is of annular configuration, wherein the inner rim 15 of the flange is located adjacent the outer surface 16 of the tube 11. It will be appreciated that whilst the figures show only a section of the flange, the flange extends through 360° about the axis of rotation 17 of the impeller. The flange 14 is generally planar and the underside of the flange 18 is flat. The vanes comprise an upper portion 19 and lower portion 20 defined by upper, lower and side edges 21, 22, 23 and 24 respectively. As shown in FIGS. 1 to 5, the upper and side edges meet substantially at right angles to define a corner 25 whereas the lower and side edges are joined by a concave formation 26 formed within the vane. However, as shown in FIG. 6, the upper and side edges may also be joined by a concave formation 25*a*, analogous to lower concave formation 26.

The inner side edges 23 of the vanes are provided with a recess 28 below the flange to provide a space 29 around the axis 17. The hollow tube 11 is provided at its end remote from the impeller with gas input means (not shown) which admits gas under super atmospheric pressure to the tube 11 where the gas is emitted at its lower end 13.

In use, the impeller shown in FIG. 1 is incorporated in apparatus as shown in FIG. 3. The apparatus comprises a tank 40 for containment of the liquid 41 to be mixed with the gas. The gas is introduced to the liquid through the tube 11 from a source remote from the tank (not shown). The tube 11 is rotated about the axis 17 in the direction shown by arrow A by any suitable means, for example an electric motor (also not shown). Of course, the direction of rotation could equally be the opposite of that shown by arrow A. There are provided in the tank, froth baffles 42 which serve to retain the froth 50 above each apparatus when there are more than one apparatus in a tank and to facilitate removal of the required mineral particles. The impeller 10 rotates and draws liquid towards the impeller creating flow paths as illustrated by the arrows L. The gas, usually air, is emitted to the liquid at the end of the tube 11 and is guided by the barrier means initially to a position generally indicated at 43. Accordingly, the liquid flow path and the gas meet at the area 43 which permits of effective aeration and accordingly efficient froth production.

It will be appreciated that there may be provided more than one apparatus in a given tank, the apparatus being arranged either adjacent to each other in series along the length of a tank or in a series of individual connected tanks.

There are provided diffusers 44 in a generally circular arrangement around the impeller 10. The diffusers serve to further mix the air and liquid, and to ensure a radial flow of air and liquid out from the impeller. The diffusers are maintained in position by webs 45 which extend downwardly at approximately 45° from a substantially cylindrical cover 46 which is attached to a support member above the tank (now shown).

The provision of the flange on the impeller significantly increases the mixing of the gas and liquid and thus improves the efficiency of froth creation and mineral extraction.

Figure 4:
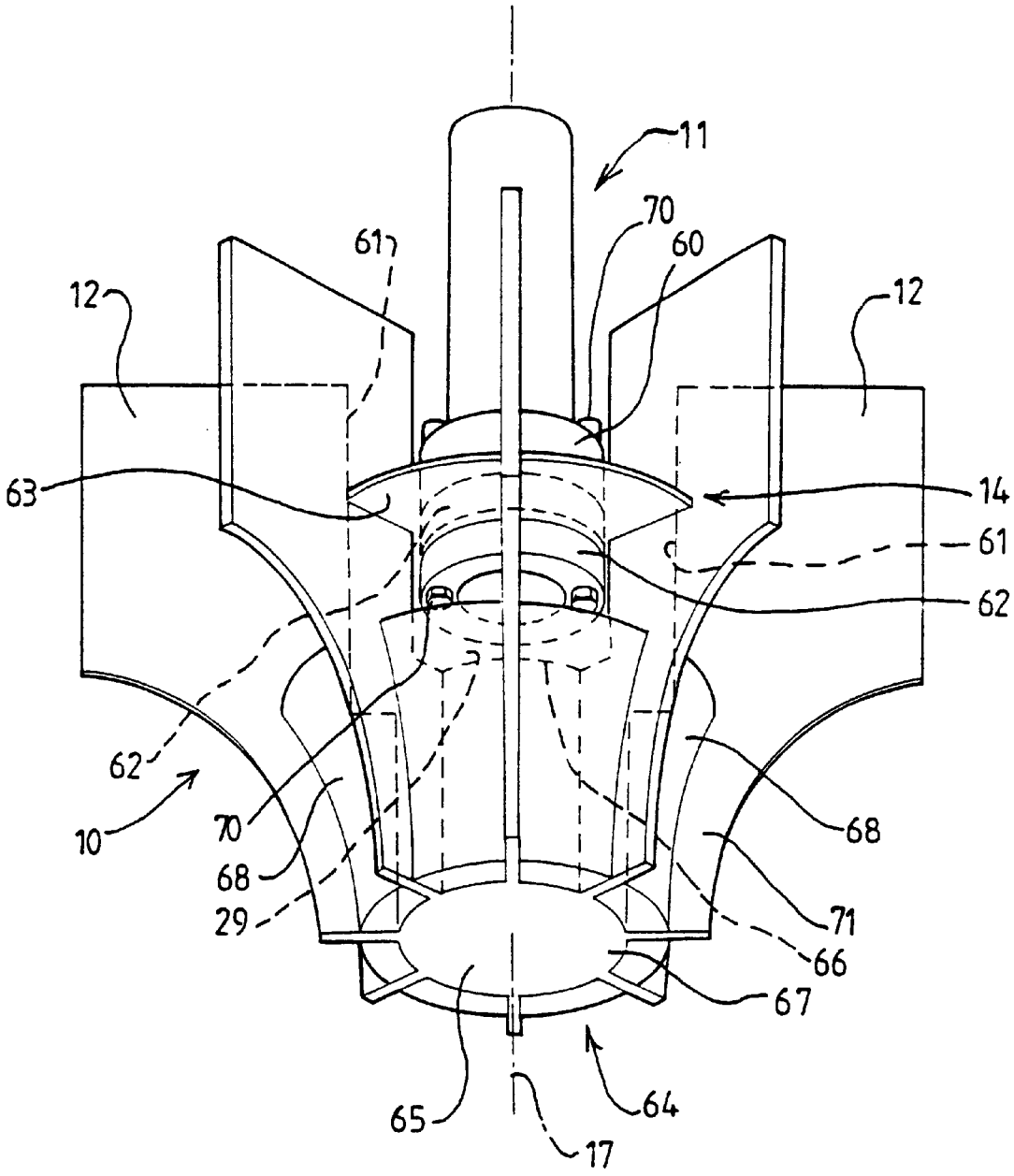
FIG. 4 is a perspective view of an alternative embodiment of the invention.

FIG. 4 illustrates an alternative embodiment of the invention. In this embodiment the impeller 10 comprises a substantially upright portion which again is a hollow tube 11, but the diameter of which is less than that of the hollow tube shown in FIGS. 1, 2 and 3. At the lower end of the tube 11 there is provided a drive flange 60 having a diameter less than the distance between opposite edges 61 of the upper parts of the vanes 12. The barrier means 14 again comprises a flange but has a first part 62 attached to the drive flange 60 and a second part 63 extending outwardly from, and attached to, the first part. The second part 63 engages the vanes 12 in a slot-like manner and the vanes are thus held secure in relation to the hollow tube 11. In the drawing, the drive flange 60 and first part 62 are shown as being secured together by bolts 70 although it will be appreciated that they may be attached to each other by any suitable means.

As also shown in FIG. 1, there is provided a space 29 about the axis 17 beneath the barrier means 14. In this example, however, the lower parts 71 of the vanes do not meet the axis 17 but there is provided a central portion 64 in the form of a cylinder 65 having closed upper and lower surfaces 66 and 67. It will be appreciated however that the upper and lower surfaces could alternatively be open so as to provide a hollow central portion.

Fluid flow baffles 68 are provided between the vanes 12. The baffles have an outer concave surface.

The fluid flow baffles serve to guide liquid flow to the area 43 as shown in FIG. 3.

Figure 5:
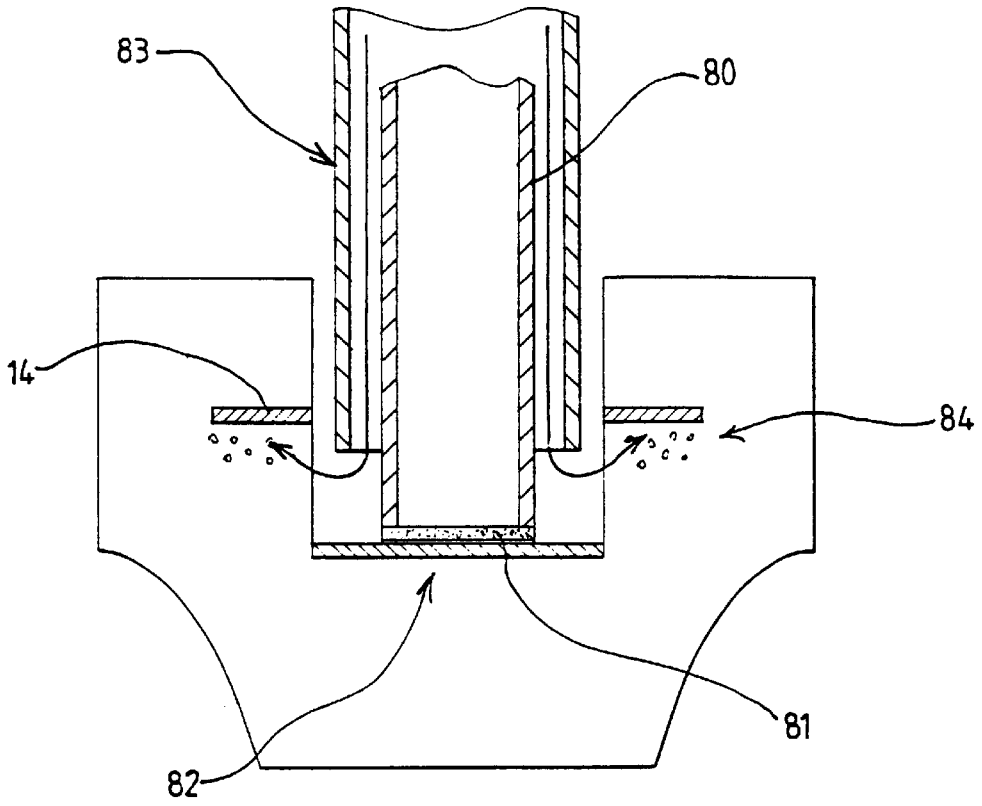
FIG. 5 is a side view of a further alternative embodiment of the invention.
Figure 6:
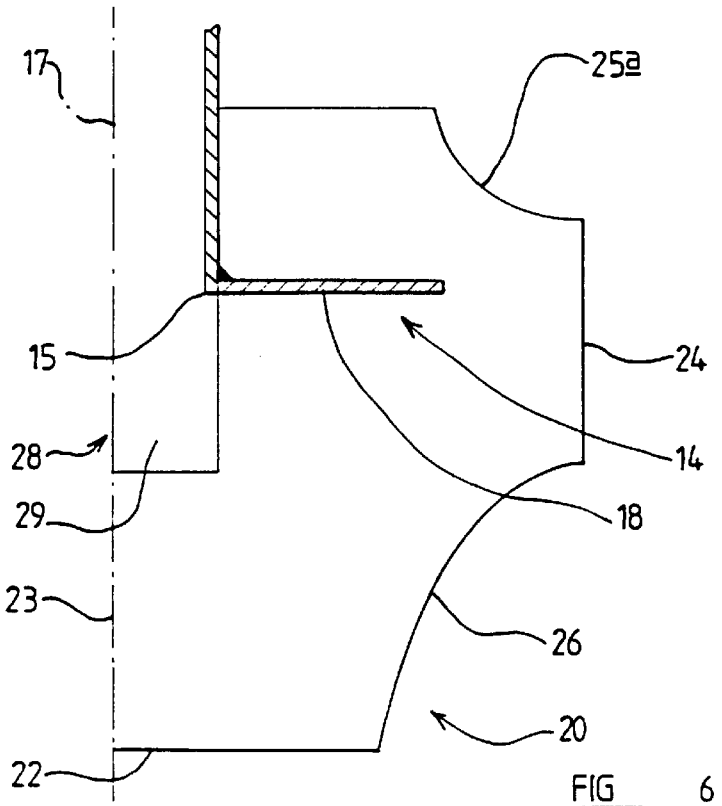
FIG. 6 is a side view of an alternative embodiment of one of the vanes and part of the barrier means.

Referring to FIG. 5, an alternative embodiment is shown wherein the substantially upright portion 80 comprises a rotatable drive shaft which is sealed at its lower end 81 and is attached to the vanes in the region generally indicated at 82. In this arrangement, there is also provided an outer pipe 83 through which gas is passed downwardly and which is emitted to the impeller at the region generally indicated at 84. The flange 14 is separate from the outer pipe and secured to the vanes. It will be appreciated that whilst this embodiment differs from those previously described, the desired effect of aeration is obtained in a manner substantially similar to that previously described. Furthermore, it will be appreciated that the outer pipe 83 at its upper regions may support the diffusers in substantially the same way as shown in FIG. 3 by reference numerals 45 and 46.

The features disclosed in the foregoing description, or the accompanying drawings, expressed in their specific forms or in terms of a means for performing the disclosed function, or a method or process for attaining the disclosed result, as appropriate, may, separately or in any combination of such features, be utilised for realising the invention in diverse forms thereof.

What is claimed is:

1. An impeller for rotation about a substantially upright axis for use with flotation tank apparatus adapted to enhance mixing of a gas and a liquid, the impeller having a substantially upright portion substantially parallel to the axis, and a plurality of vanes extending outwardly therefrom, at least some of the vanes having an upper part exposed to an upper part of the flotation tank apparatus, the upper part of the vanes being adapted to induce liquid flow from the upper part of the flotation tank apparatus generally downwardly towards the impeller, said at least some of the vanes further having a lower part adapted to induce liquid flow from a lower part of the flotation tank apparatus generally upwardly towards the impeller, characterized in that the impeller further comprises barrier means at least partially separating said upper and lower parts, and a gas input situated on the same side of the barrier means as the lower part, the barrier means, in use, serving to guide gas and liquid along a lower surface thereof towards an outer edge thereof so that some gas/liquid mixing may occur between said gas input and said outer edge.

2. An impeller according to claim 1 wherein the barrier means guides the gas and the liquid initially to a position generally adjacent an outer edge thereof.

3. An impeller according to claim 1 wherein the barrier means comprises a flange-like member having upper and lower faces, at least one face of which is flat or substantially flat.

4. An impeller according to claim 3 wherein the flange-like member is substantially planar.

5. An impeller according to claim 3 wherein the flange-like member lies in a plane substantially perpendicular to the axis of rotation.

6. An impeller according to claim 3 wherein the flange-like member is disc shaped.

7. An impeller according to claim 4 wherein a lower end of the substantially upright portion is located below the plane of the barrier means.

8. An impeller according to claim 1 wherein the substantially upright portion is substantially hollow.

9. An impeller according to claim 1 wherein only a part of each vane engages the substantially upright portion.

10. An impeller according to claim 1 wherein the barrier means comprises an annulus, an inner rim of which is located substantially adjacent the outer surface of the substantially upright portion.

11. An impeller for rotation about a substantially upright axis for use with apparatus adapted to enhance mixing of a gas and a liquid, the impeller having a substantially upright portion substantially parallel to the axis, and a plurality of vanes extending outwardly therefrom, at least some of the vanes having an upper part adapted to induce liquid flow generally downwardly towards the impeller and a lower part adapted to induce liquid flow generally upwardly towards the impeller, characterized in that the impeller further comprises barrier means at least partially separating said upper and lower parts, and a gas input situated on the same side of the barrier means as the lower part, the barrier means, in use, serving to guide gas and liquid along a lower surface thereof towards an outer edge thereof so that some gas/liquid mixing may occur between said gas input and said outer edge, wherein the barrier means comprises an annulus, an inner rim of which is located substantially adjacent the outer surface of the substantially upright portion, and wherein the radius of the annulus is less than the dimension of the vanes in a radial direction.

12. An impeller according to claim 1 wherein part of each vane has a generally concave configuration.

13. An impeller according to claim 1 wherein substantially upright portion comprises a cylinder-like portion and wherein the vanes extend outwardly therefrom but do not engage the outer surface of the cylinder-like portion.

14. An impeller according to claim 13 wherein the cylinder-like portion has associated therewith a drive flange, and wherein the barrier means is attached to or integral with the drive flange.

15. An impeller according to claim 1 wherein there is provided baffle means between adjacent vanes of the impeller.

16. An impeller for rotation about a substantially upright axis for use with apparatus adapted to enhance mixing of a gas and a liquid, the impeller having a substantially upright portion substantially parallel to the axis, and a plurality of vanes extending outwardly therefrom, at least some of the vanes having an upper part adapted to induce liquid flow generally downwardly towards the impeller and a lower part adapted to induce liquid flow generally upwardly towards the impeller, characterized in that the impeller further comprises barrier means at least partially separating said upper and lower parts, and a gas input situated on the same side of the barrier means as the lower part, the barrier means, in use, serving to guide gas and liquid along a lower surface thereof towards an outer edge thereof so that some gas/liquid mixing may occur between said gas input and said outer edge, wherein there is provided baffle means between adjacent vanes of the impeller, and wherein the baffle means have a concave outer surface.

17. An impeller according to claim 13 wherein there is a provided an outer pipe, preferably concentric with the cylinder-like portion, which does not rotate with the vanes.

18. An impeller according to claim 17 wherein gas is emitted to the liquid through the outer pipe, which has an open lower end.

19. An impeller according to claim 18 wherein the lower end of the outer pipe is also located below the plane of the barrier means.

20. A method of mixing a gas and a liquid, comprising the steps for introducing the gas to the liquid, and inducing flow of the gas and liquid to enhance mixing thereof by use of an impeller in accordance with claim 1.

21. An impeller for mixing of a gas and a liquid in a flotation tank, comprising:

a substantially upright portion defining a substantially upright axis of rotation, the substantially upright portion having a gas flow line extending therethrough;

a plurality of vanes extending outwardly from the substantially upright portion, at least some of the vanes having an upper part which is exposed to the flotation tank and adapted to induce liquid flow generally downwardly and a lower part which is exposed to the flotation tank and adapted to induce liquid flow generally upwardly; and a barrier at least partially separating the upper and lower parts of the vanes, the barrier having a lower surface for gas/liquid mixing therealong towards an outer edge;

the gas flow line terminating in a gas input to the vanes, the gas input being situated below the lower surface of the barrier, such that the barrier, in use, serves to guide gas and liquid along its lower surface towards its outer edge, so that some gas/liquid mixing may occur between said gas input and the outer edge of the barrier.

22. The impeller of claim 21, wherein the barrier is an annular barrier wall extending generally perpendicular to the axis of rotation.

* * * * *